US009272890B2

(12) United States Patent
Lawlor et al.

(10) Patent No.: US 9,272,890 B2
(45) Date of Patent: Mar. 1, 2016

(54) CORKSCREW ASSEMBLY FOR USE WITH A POWER TOOL

(71) Applicants: Robert Bosch Tool Corporation, Broadview, IL (US); Robert Bosch GmbH, Stuttgart (DE)

(72) Inventors: Michael Lawlor, Chicago, IL (US); Xinhui Zhang, Hangzhou (CN); Jiguo Liu, Hangzhou (CN); Chengyuan Wei, Hangzhou (CN); Xingjie Zhu, Providence, RI (US)

(73) Assignee: Robert Bosch GmbH, Stuttgart (DE)

( * ) Notice: Subject to any disclaimer, the term of this patent is extended or adjusted under 35 U.S.C. 154(b) by 545 days.

(21) Appl. No.: 13/667,381

(22) Filed: Nov. 2, 2012

(65) Prior Publication Data

US 2013/0112044 A1 May 9, 2013

(30) Foreign Application Priority Data

Nov. 3, 2011 (CN) ..... 2011 1 0364570

(51) Int. Cl.
*B67B 7/00* (2006.01)
*B67B 7/04* (2006.01)
*B67B 7/18* (2006.01)

(52) U.S. Cl.
CPC ..... *B67B 7/0441* (2013.01); *B67B 7/0405* (2013.01)

(58) Field of Classification Search
CPC .. B67B 7/0441; B67B 7/0447; B67B 7/0405; B67B 7/0415
USPC ..... 81/3.29, 3.45, 3.48
See application file for complete search history.

(56) References Cited

U.S. PATENT DOCUMENTS

| | | | | |
|---|---|---|---|---|
| 5,503,047 | A | 4/1996 | Brockington | |
| 5,934,160 | A * | 8/1999 | Gibson | 81/3.37 |
| 6,145,411 | A * | 11/2000 | Chen | 81/3.29 |
| 7,395,737 | B2 * | 7/2008 | Zhou | 81/3.37 |
| 2002/0152846 | A1 * | 10/2002 | Lozeau et al. | 81/3.09 |

(Continued)

FOREIGN PATENT DOCUMENTS

| | | | |
|---|---|---|---|
| DE | 3713263 | A1 | 11/1988 |
| DE | 202005018466 | U1 | 1/2006 |
| EP | 0930265 | A1 | 7/1999 |
| EP | 0930265 | A1 * | 7/1999 |

(Continued)

OTHER PUBLICATIONS

Partial International Search in corresponding PCT application (PCT/US2012/063321), mailed Mar. 1, 2013 (6 pages).

*Primary Examiner* — Bryan R Muller
(74) *Attorney, Agent, or Firm* — Maginot Moore & Beck LLP

(57) ABSTRACT

A corkscrew assembly includes a housing a worm screw assembly, a first gripper, and a second gripper. The housing defines (i) a first opening configured to receive a neck of a bottle, (ii) a second opening, and (iii) an interior space interposed between the first opening and the second opening. The housing includes a sidewall extending from the first opening to the second opening. The sidewall defines a first gripper passage and a second gripper passage. The interior space is interposed between the first gripper passage and the second gripper passage. The worm screw assembly is rotatable in relation to the housing and includes (i) a worm screw member having a pointed first end portion and a second opposite end portion and (ii) a drive member fixed in relation to the second opposite end portion.

12 Claims, 8 Drawing Sheets

(56) References Cited

U.S. PATENT DOCUMENTS

2006/0112788 A1* 6/2006 Cheung ..... 81/3.37
2007/0193415 A1* 8/2007 Isaacson ..... 81/3.2

FOREIGN PATENT DOCUMENTS

WO 02079072 A1 10/2002
WO 03068661 A1 8/2003

* cited by examiner

CORKSCREW ASSEMBLY FOR USE WITH A POWER TOOL

This application claims priority under 35 U.S.C. §119 to patent application no. CN 2011 1036 4570.5, filed on Nov. 3, 2011 in China, the disclosure of which is incorporated herein by reference in its entirety

FIELD

This disclosure relates generally to bottle opening assemblies and particularly to assemblies for removing a stopper from a bottle.

BACKGROUND

A stopper is commonly used to close the opening in a bottle. Typically, the stopper is made of natural cork or a synthetic material having the desirable qualities of natural cork. Each type of stopper (referred to herein simply as a "cork" regardless of the material from which it is formed) is elastically compressible and generally does not absorb water. The cork conforms to the interior shape of the bottle opening and forms an airtight and watertight seal. A common example is the cork used to close the opening in a wine bottle. When the wine bottle is properly cellared, the cork prevents air from entering the bottle through the opening and prevents the wine from escaping through the opening.

There are numerous devices available to remove the cork from the opening in the bottle. A common device for uncorking a bottle is referred to as a corkscrew. The typical corkscrew includes helically wound wire with a handle connected at one end and a pointed tip at an opposite end. The helically wound wire is threaded into the cork by rotating the handle. The bottle is uncorked by grasping the handle and pulling the corkscrew away from the bottle opening. Since the helically wound wire is threaded into the cork, moving the corkscrew away from the bottle pulls the cork out of the opening.

The type of corkscrew described above functions well to uncork a bottle. Some users, however, may lack the manual dexterity or physical strength necessary to pull the cork out of the opening. Additionally, other users, such as those in the restaurant or catering industry, open many bottles of wine in a single service. These commercial users may determine that the type of corkscrew described above is simply too slow to efficiency serve each patron.

Accordingly, there is a continuing need for a corkscrew assembly that uncorks a bottle easily and quickly.

SUMMARY

According to one embodiment of the disclosure a corkscrew assembly includes a housing, a worm screw assembly, a first gripper, and a second gripper. The housing defines (i) a first opening configured to receive a neck of a bottle, (ii) a second opening, and (iii) an interior space interposed between the first opening and the second opening. The housing further includes a sidewall extending from the first opening to the second opening. The sidewall defines a first gripper passage and a second gripper passage. The interior space is interposed between the first gripper passage and the second gripper passage. The worm screw assembly is rotatable in relation to the housing and includes (i) a worm screw member having a pointed first end portion and a second opposite end portion and (ii) a drive member fixed in relation to the second opposite end portion. The worm screw assembly is configured such that rotation of the drive member causes rotation of the worm screw. The first gripper is movable in relation to the housing and extends through the first gripper passage. The second gripper is movable in relation to the housing and extends though the second gripper passage.

According to another embodiment of the disclosure a corkscrew assembly includes a housing, a cap, and a worm screw assembly. The housing defines (i) a first opening configured to receive a neck of a bottle, (ii) a second opening, and (iii) an interior space interposed between the first opening and the second opening. The housing includes an abutment structure located in the interior space. The cap is attached to the housing. The worm screw assembly is rotatable in relation to the housing and includes (i) an interface structure at least partially positioned in the interior space and including a stop, (ii) a worm screw member having a pointed first end portion and a second opposite end portion attached to the interface structure, and (iii) a drive member attached to the interface structure and fixed in relation to the second opposite end portion. The worm screw assembly is movable in relation to the housing between a first position and a second position. When the worm screw assembly is positioned in the first position, the stop is positioned in contact with the abutment structure. When the worm screw assembly is positioned in the second position, the stop is positioned in contact with the cap to prevent removal of the stop from the interior space.

According to yet another embodiment of the disclosure a corkscrew assembly includes a housing, a drive member, and a worm screw member. The housing defines (i) a first opening configured to receive a neck of a bottle, (ii) a second opening, and (iii) an interior space interposed between the first opening and the second opening. The drive member is rotatable in relation to the housing and includes a threaded end portion defining a plurality of external threads. The worm screw member is at least partially positioned in the interior space and includes a pointed first end portion and a second opposite end portion. The second opposite end portion defines a plurality of internal threads. The plurality of external threads are meshingly engaged with the plurality of internal threads to connect the worm screw member to the drive member.

BRIEF DESCRIPTION OF THE FIGURES

The above-described features and advantages, as well as others, should become more readily apparent to those of ordinary skill in the art by reference to the following detailed description and the accompanying figures in which.

DETAILED DESCRIPTION

Figure 1:
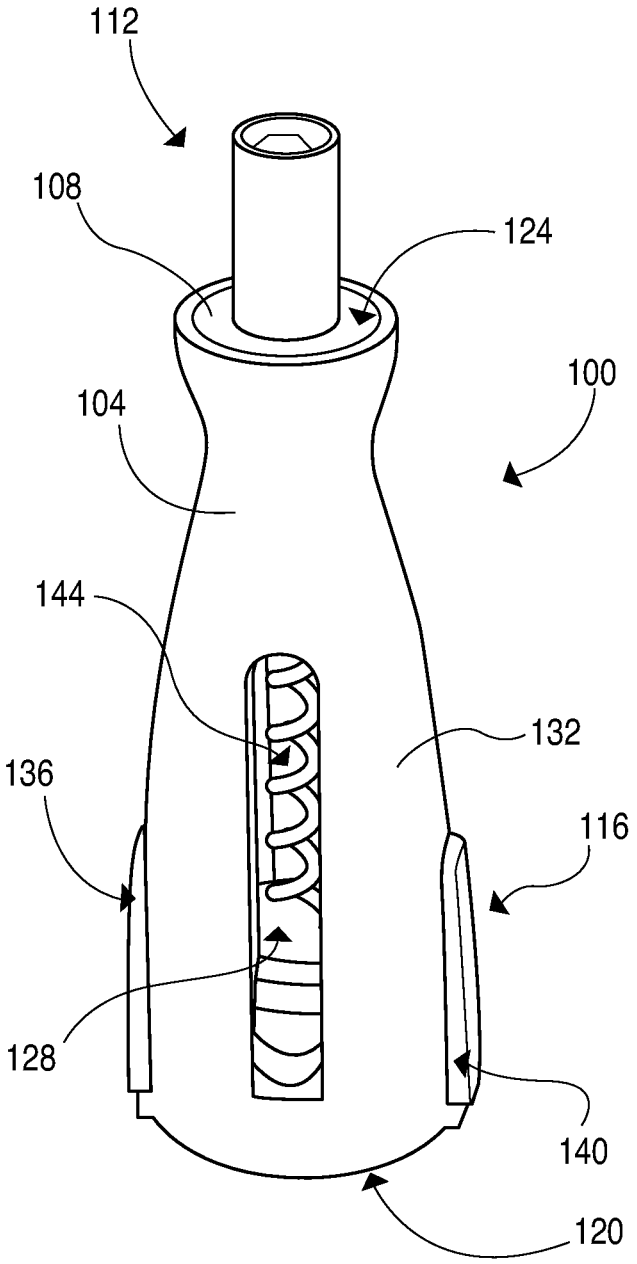
FIG. 1 shows a perspective view of a corkscrew assembly according to one embodiment of the disclosure.

For the purpose of promoting an understanding of the principles of the disclosure, reference will now be made to the embodiments illustrated in the drawings and described in the following written specification. It is understood that no limitation to the scope of the disclosure is thereby intended. It is further understood that the present disclosure includes any alterations and modifications to the illustrated embodiments and includes further applications of the principles of the disclosure as would normally occur to one skilled in the art to which this disclosure pertains.

Figure 2:
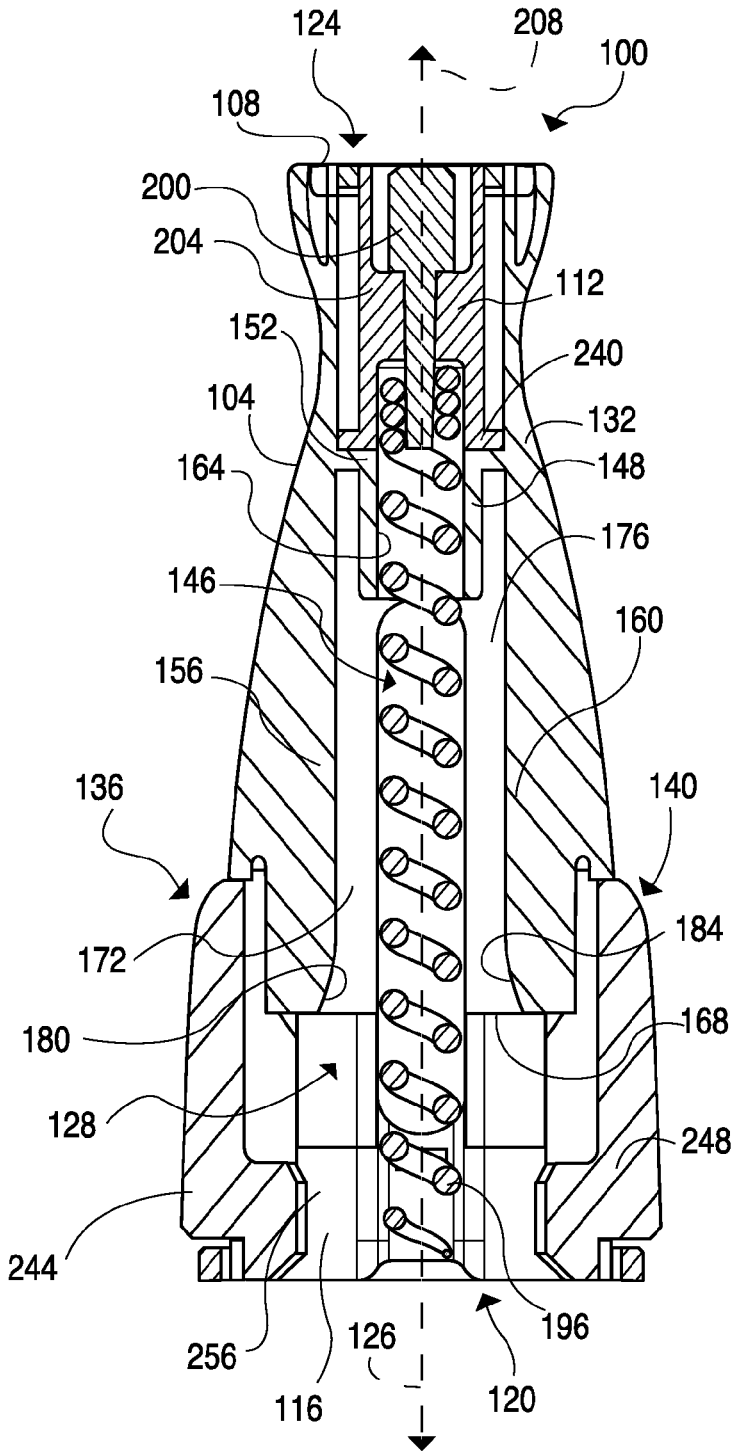
FIG. 2 shows a cross sectional view of the corkscrew assembly of FIG. 1, with a worm screw assembly of the corkscrew assembly shown in a lower position.

As shown in FIG. 1, a corkscrew assembly 100 includes a housing 104, a cap 108, a worm screw assembly 112, and a grip structure 116. The housing 104 defines a lower opening 120, an upper opening 124, and a longitudinal axis 126 (FIG. 2). The lower opening 120 is configured to receive the neck N (FIGS. 4 and 6) of a bottle B. The upper opening 124 is positioned on an end of the housing 104 opposite to the lower opening 120. The housing 104 defines an interior space 128 that is interposed between the lower opening 120 and the upper opening 124. The housing 104 is formed of injection molded thermoplastic. Other materials are possible.

The housing 104 includes a sidewall 132 that extends from the lower opening 120 to the upper opening 124. The sidewall 132 defines a gripper passage 136, a gripper passage 140, a window 144, and window 146 (FIG. 2). The gripper passage 136 is positioned on a side of the housing 104 opposite from the gripper passage 140. The interior space 128 is interposed between the gripper passage 136 and the gripper passage 140. The window 144 is positioned between the gripper passage 136 and the gripper passage 140. The window 146 is positioned on a side of the housing 104 opposite from the window 144.

As shown in FIG. 2, the housing 104 further includes a bore structure 148, an abutment structure 152, a rib structure 156, and a rib structure 160. The bore structure 148 is positioned between the upper opening 124 and the gripper passages 136, 140. The bore structure 148 defines a cylindrical interior bearing surface 164 for the worm screw assembly 112. The abutment structure 152 is positioned at an upper end of the cylindrical interior bearing surface 164 and abuts a portion of the worm screw assembly 112 when the worm screw assembly is in a lower position, as shown in FIG. 2. The abutment structure 152 is positioned in the interior space 128.

The rib 156 and the rib 160 are positioned within the interior space 128 between the abutment structure 152 and a shoulder 168 of the housing 104. The rib 156 extends toward the longitudinal axis 126 from an inner wall 172 of the housing. The rib 160 also extends toward the longitudinal axis 126 of the housing 104 from an inner wall 176 of the housing. The rib 156 includes a tapered end portion 180 positioned near the shoulder 168. The rib 160 also includes a tapered end portion 184 positioned near the shoulder 168.

Figure 3:
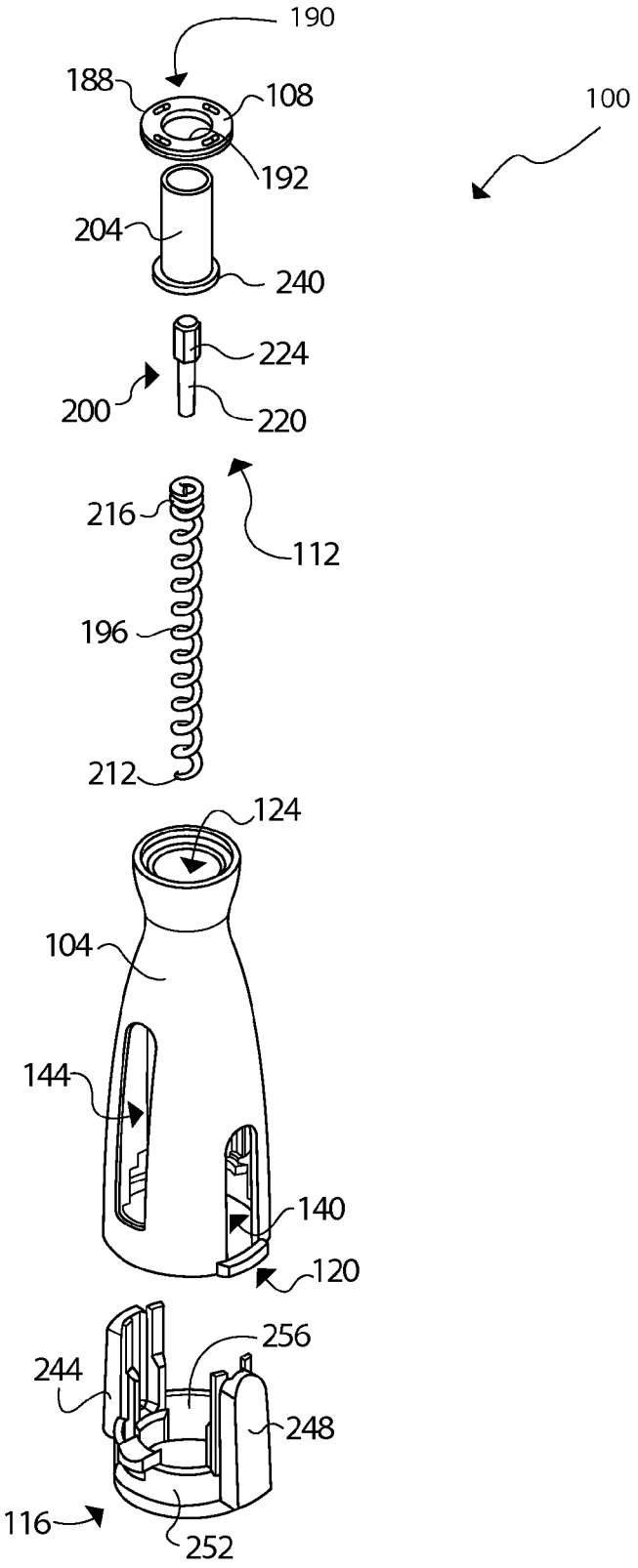
FIG. 3 shows an exploded perspective view of the corkscrew assembly of FIG. 1.

As shown in FIG. 3, the cap 108 defines a circular periphery 188 and a circular opening 190, which defines a cylindrical interior bearing surface 192. The cap 108 is attached to the upper opening 124 and is made of injection molded thermoplastic. Other materials are possible.

With continued reference to FIG. 3, the worm screw assembly 112 includes a worm screw member 196, a drive member 200, and an interface structure 204. The worm screw member 196 defines a longitudinal axis 208 (FIG. 2) that extends through the lower opening 120 and the upper opening 124 and is coaxial with the longitudinal axis 126. The worm screw member 196 includes a pointed end portion 212 and a second opposite end portion 216. The end portion 212 pierces a cork C to enable the worm screw member 196 to thread into the cork. The end portion 216 is attached to the interface structure 204 and the drive member 200 in any manner known to those of ordinary skill in the art. The worm screw member 196 is made of metal.

With reference again to FIG. 2, the worm screw member 196 is at least partially positioned within the interior space 128 of the housing 104 and is rotatable relative to the housing. The worm screw member 196 is positioned in contact with the cylindrical interior bearing surface 164 during rotation of the worm screw assembly 112. The cylindrical interior bearing surface 164 supports the worm screw member 196 so that the longitudinal axis 208 remains coaxial with the longitudinal axis 126 during movement of the worm screw assembly 112 relative to the housing 104.

As shown in FIG. 3, the drive member 200 includes a shaft portion 220 extending from a connection head 224. The drive member 200 is fixed in relation to the end portion 212 and the end portion 216. Rotation of the drive member 200 causes rotation of the worm screw member 196.

The shaft portion 220 is fixed in relation to the end portion 216 of the worm screw member 196. The connection head 224 is connectable to a power tool T (FIG. 5), such as an electric screwdriver. In one particular embodiment, the connection head 224 is connectable to an electric screwdriver, such as the Skil® iXO screwdriver manufactured by the Robert Bosch Tool Corporation. The drive member 200 is made of metal and is attached to the interface structure 204.

Figure 4:
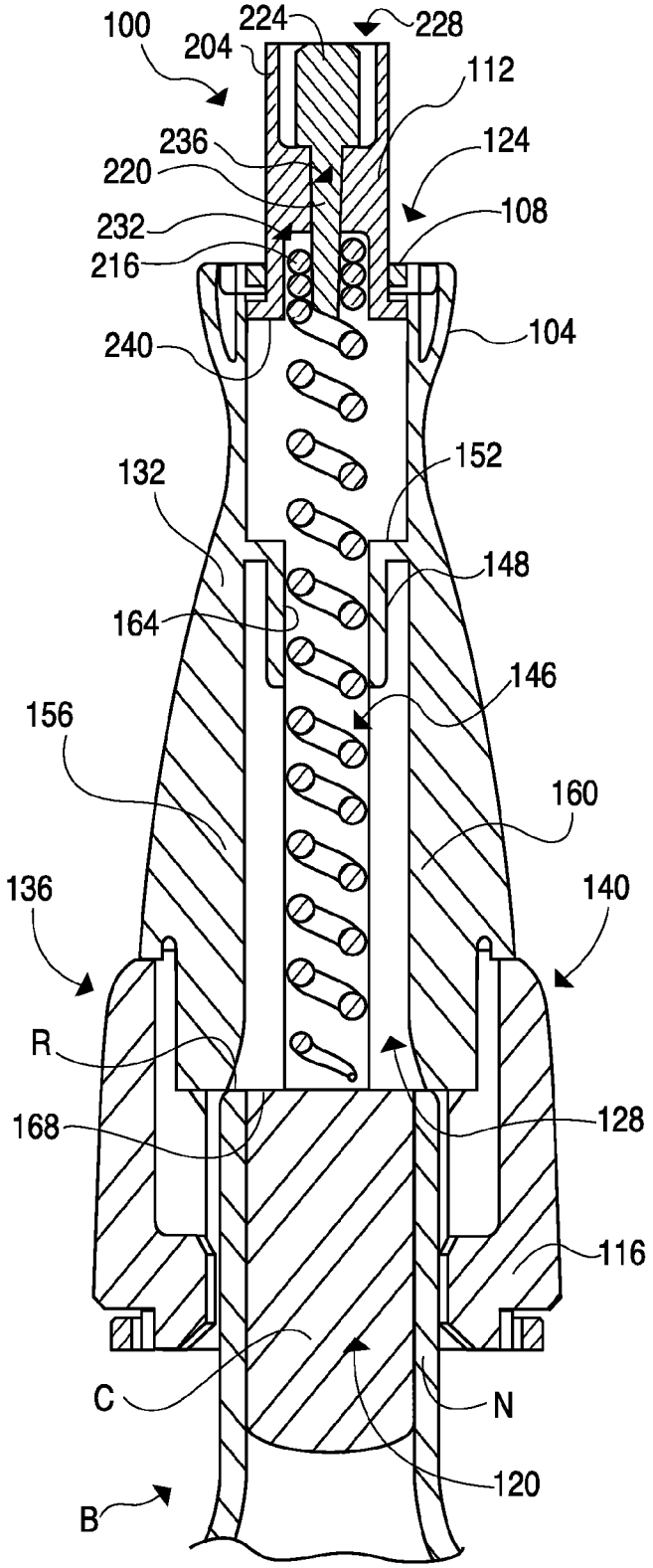
FIG. 4 shows a cross sectional view of the corkscrew assembly of FIG. 1, with the worm screw assembly in an upper position and with the corkscrew assembly having received a neck portion of a bottle with a cork positioned therein.

As shown in FIG. 4, the interface structure 204 is at least partially positioned in the interior space 128 and defines an upper recess 228 and a lower recess 232 fluidly connected by a channel 236. The interface structure 204 includes a stop 240 positioned at an end portion of the interface structure near the lower recess 232. The interface structure 204 is made from injection molded thermoplastic. Other materials are possible.

The interface structure 204 receives at least a portion of the drive member 200 and the worm screw member 196. In particular, the connection head 224 of the drive member 200 is positioned in the upper recess 228, and the shaft portion 220 is at least partially positioned in the channel 236 and in the lower recess 232. The end portion 216 of the worm screw member 196 is positioned in the lower recess 232.

The worm screw assembly 112 is rotatable and slidable relative to the housing 104, but is not completely removable from the housing. In particular, the worm screw assembly 112 is movable relative to the housing 104 between an upper position (FIGS. 1, 4 and 5) and a lower position (FIGS. 2 and 6). In the upper position the stop 240 is positioned in contact with the cap 108, and in the lower position the stop is positioned in contact with the abutment structure 152. Accordingly, the stop 240 is not removable from the interior space 128, and, as a result, the worm screw assembly 112 is rotatable and displaceable relative to the housing 104, but is not separable from the housing. In this way, the worm screw assembly 112 remains with the housing 104 to prevent misplacement of the either the worm screw assembly or the housing.

The interior bearing surface 164 and the interior bearing surface 192 guide the worm screw assembly 112 as it moves between the upper position and the lower position. Specifically, the interface structure 204 is positioned in contact with the interior bearing surface 192 and the worm screw assembly 196 is positioned in contact with the bearing surface 164 during movement of the worm screw assembly 112 between the upper position and the lower position.

As shown in FIG. 3, the grip structure 116 includes a gripper 244, a gripper 248, a biaser 252, and a biaser 256. The grip structure 116 is integrally formed as a monolithic part (a single part) from an elastomeric material.

With reference again to FIG. 2, the gripper 244 extends through the gripper passage 136 and is movable in relation to the housing 104 between a release position (shown in FIG. 2) and a grip position (FIG. 6) in which the gripper 244 is moved toward the longitudinal axis 208 against the bottle B. Similarly, the gripper 248 extends through the gripper passage 140 and is movable in relation to the housing 104 between a release position (shown in FIG. 2) and a grip position (FIG. 6) in which the gripper 248 is moved toward the longitudinal axis 208 against the bottle B.

The biaser 252 and the biaser 256 urge the grippers 244, 248 toward the release positions. In particular, the biaser 252 (FIG. 3) is connected to the gripper 244 and is located in the interior space 104. The biaser 252 is configured to urge the gripper 244 toward the release position away from the longitudinal axis 208. Likewise, the biaser 256 (FIG. 3) is connected to the gripper 248 and is located in the interior space 104. The biaser 256 is configured to urge the gripper 248 toward the release position away from the longitudinal axis 208.

In operation, the corkscrew assembly 100 is used in combination with the power tool T to uncork the bottle B. As shown in FIG. 4, to uncork the bottle B, the neck N of the bottle is inserted through the lower opening 120 into the interior space 128. As the neck N is moved toward the shoulder 168, the cork C contacts the pointed end portion 212 and moves the worm screw assembly 112 to the upper position. The neck N is moved into the interior space 128 until an upper rim R of the bottle B is seated against the shoulder 168 (as shown in FIG. 4).

Figure 5:
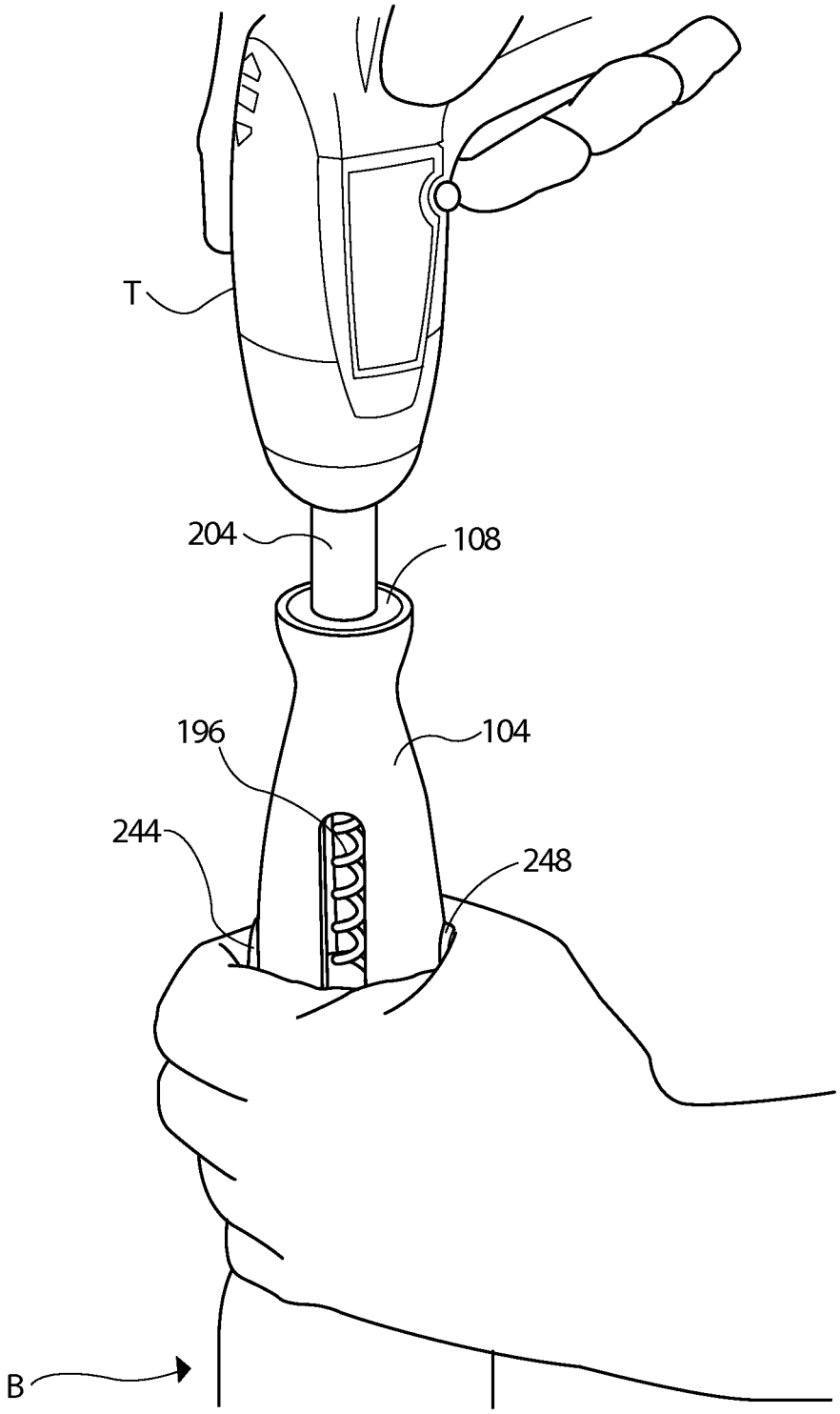
FIG. 5 shows a perspective view of the corkscrew assembly of FIG. 1, the bottle, and a power tool for operating the corkscrew assembly.
Figure 6:
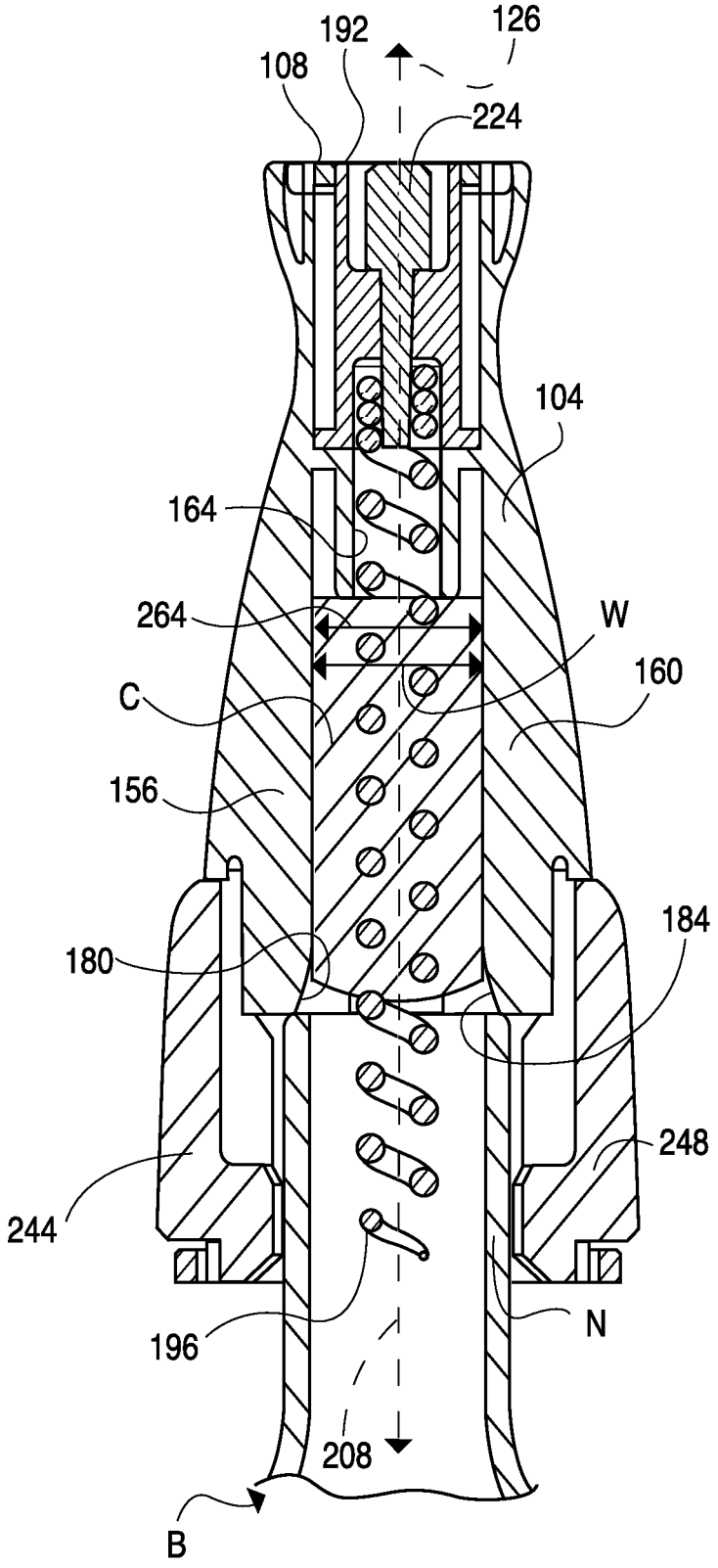
FIG. 6 shows a cross sectional view of the corkscrew assembly of FIG. 1 after the worm screw assembly has withdrawn the cork from an opening of the bottle.

Next, as shown in FIG. 5, the user firmly grasps the housing 104, the bottle B, the gripper 244, and the gripper 248. When grasped, the gripper 244 moves to the grip position and the gripper 248 moves to the grip position, such that the gripper 244 and the gripper 248 are positioned against the neck N. Positioning the gripper 244 and the gripper 248 against the neck N prevents movement of the housing 104 and the grip structure 116 relative to the bottle B when the power tool T is activated.

Next the power tool T is positioned so that an output shaft (not shown) of the power tool receives the connection head 224 of the drive member 200. When the output shaft receives the connection head 224, rotation of the output shaft causes rotation of the worm screw assembly 112 relative to the housing 104.

Next, the user applies pressure to the power tool T directed toward the bottle B and then activates the power tool to cause the output shaft to rotate in a clockwise direction. The rotation of the worm screw member 196 and the downward directed pressure causes the pointed tip 212 to pierce the cork C and then to thread into the cork. As the worm screw member 196 threads into the cork C, the worm screw assembly 112 moves to the lower position.

As shown in FIG. 6, after the worm screw assembly 112 enters the lower position, continued rotation of the worm screw assembly causes the worm screw member 196 to withdraw the cork C from the neck N of the bottle B as the worm screw member is threaded further into the cork. As the worm screw member 196 withdraws the cork C, the cork is forced against the rib 156 and the rib 160. A distance 264 (FIG. 6) between the rib 156 and the rib 160 is slightly less than a width W of the cork C such that a friction fit is established between the ribs 156, 160 and the cork. The friction fit prevents rotation of the cork C relative to the housing 104 as the worm screw member 196 withdraws the cork. The tapered end portions 180, 184 of the ribs 156, 160 center the cork C about the longitudinal axis 208 as the cork is withdrawn. The user looks through the window 144 (FIG. 3) to determine when the cork C has been completely withdrawn from the neck N.

After the bottle B has been uncorked, the power tool T is deactivated to stop rotation of the worm screw assembly 112. Thereafter, the power tool T is disconnected from the corkscrew assembly 100. Then, the corkscrew assembly 100 is separated from the bottle B by the user releasing the grasp on the gripper 244 and the gripper 248 and moving the corkscrew assembly 100 away from the bottle B.

After being removed from the bottle B, the corkscrew assembly 100 contains the cork C within the interior space 128. To eject the cork C from the corkscrew assembly 100, the power tool T is configured to rotate the output shaft in a counterclockwise direction. With the power tool T in a deactivated configuration the power tool is again positioned for the output shaft to receive the drive member 200. Thereafter, when the power tool T is energized, the rotation of the worm screw member 196 in the counterclockwise direction causes the worm screw assembly 112 to move to the upper position, and then causes cork C to slide down the ribs 156, 160 until the worm screw member 196 is withdrawn from the cork and the cork falls from the interior space 128. After the cork is withdrawn from the interior space the corkscrew assembly 100 is ready to uncork another bottle. The uncorking operation using the corkscrew assembly 100 takes approximately ten to fifteen seconds.

Figure 7:
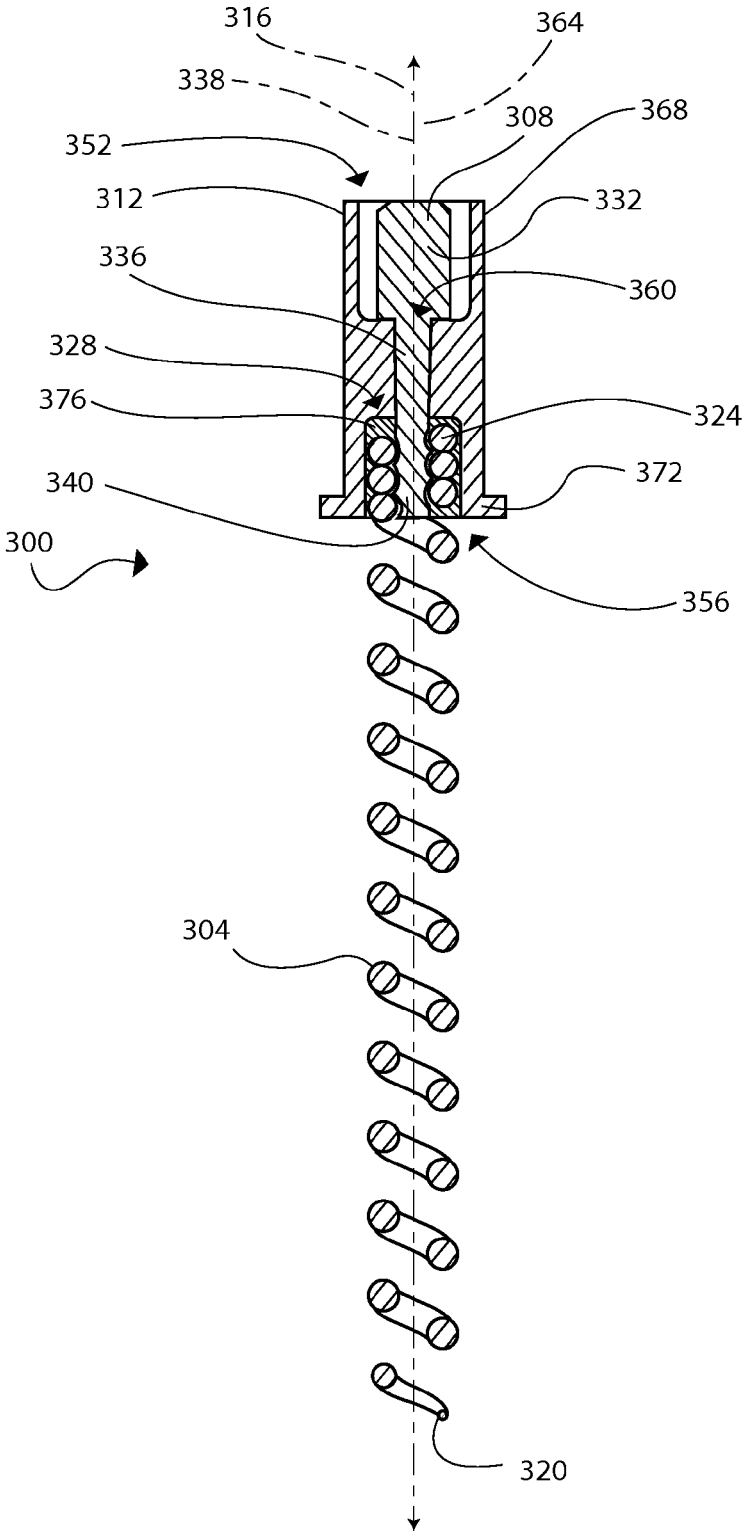
FIG. 7 shows a cross sectional view of an alternative embodiment of the worm screw assembly for use with the corkscrew assembly of FIG. 1.
Figure 8:
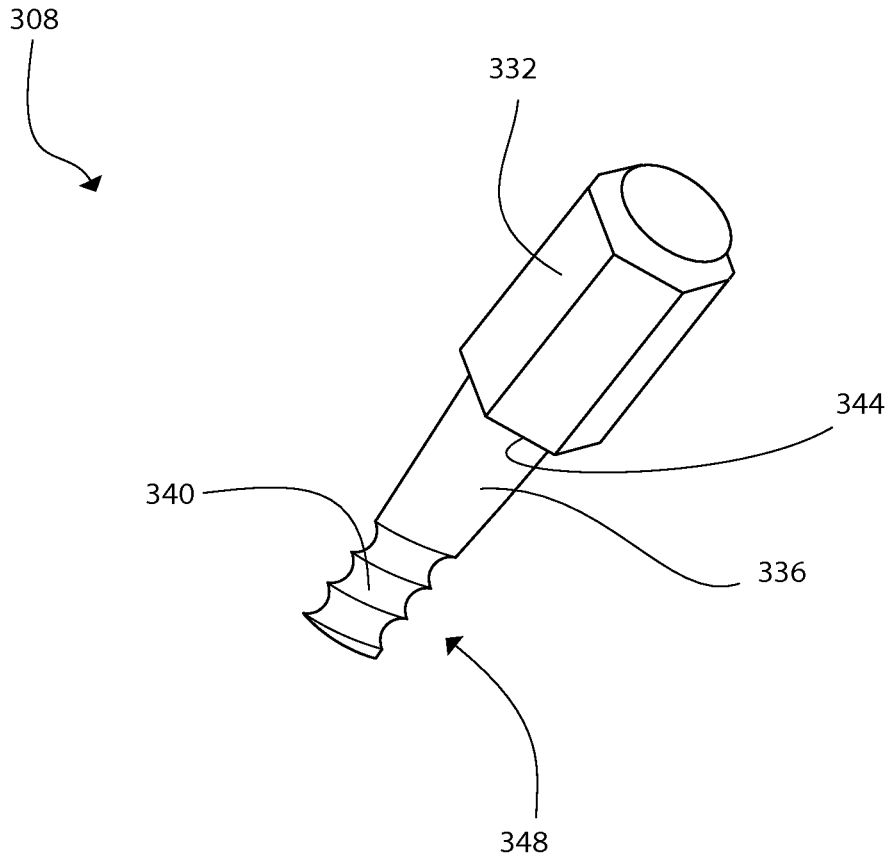
FIG. 8 shows a perspective view of a drive member of the worm screw assembly of FIG. 7.

As shown in FIGS. 7 and 8, another embodiment of a worm screw assembly 300 for use with the housing 104 and the grip structure 116 includes a worm screw member 304, a drive member 308, and an interface structure 312. The worm screw member 304 defines a longitudinal axis 316 that extends through the lower opening 120 and the upper opening 124 and is coaxial with the longitudinal axis 126. The worm screw member 304 is at least partially positioned within the interior space 128 of the housing 104 and is rotatable relative to the housing. The worm screw member 304 is positioned in contact with the cylindrical interior bearing surface 164 during rotation of the worm screw assembly 300.

The worm screw member 304 is formed from a generally cylindrical segment of metal that is wound to approximately a helical configuration having an approximately equal pitch between most of the revolutions. The worm screw member 304 includes a non-stick coating (not shown), typically, polytetrafluoroethylene (PTFE) (Teflon®), to make the worm screw member thread easily into the cork C.

The worm screw member 304 includes a pointed end portion 320 and a second opposite end portion 324. The end portion 320 pierces a cork C to enable the worm screw member 304 to thread into the cork.

The end portion 324 opposite the pointed end portion 320 includes three revolutions of the worm screw member 304. The revolutions of the end portion 324 are positioned against each other to form a set of internal threads 328.

As shown in FIG. 8, the drive member 308 includes a connection head 332 and a shaft portion 336 having a connection structure 340. The drive member 308 defines a longitudinal axis 338 that is coaxial with the longitudinal axis 316. The connection head 332 is connectable to a power tool T (FIG. 5), such as an electric screwdriver. In one particular embodiment, the connection head 332 is connectable to an electric screwdriver, such as the Skil® iXO screwdriver manufactured by the Robert Bosch Tool Corporation. The connection head 332 has a generally hexagonal periphery similar to a typical hex nut. The connection head 332, like the entire drive member 308, is made of metal.

The shaft portion 336 extends from the connection head 332. The shaft portion 336 is narrower than the connection head 332, such that a shoulder 344 is defined between the shaft portion and the connection head. The shaft portion 336 is generally frusto-conical and is widest near the connection head 332.

The connection structure 340 is a threaded end portion, which defines a plurality of external threads referred to as a helical groove 348. The helical groove 348 corresponds to the profile of the internal threads 328 defined by the end portion 324; however, the groove 348 is slightly wider than the internal threads 328.

The interface structure 312 defines an upper recess 352 and a lower recess 356 fluidly connected by a channel 360. A longitudinal axis 364 of the interface structure 312 extends through a center of the upper recess 352, the channel 360, and the lower recess 356. The upper recess 352 receives at least a portion of the connection head 332. The length of the upper recess 352 as measured in a direction parallel to the longitudinal axis 364 is approximately equal to the length of the connection head 332 as measured in the same direction.

The channel 360 is defined by a generally frusto-conical surface of the interface structure 312. The shape of the channel 360 matches approximately the shape of the shaft portion 336, however, the channel is slightly narrower than the shaft portion.

The lower recess 356 receives at least a portion of the end portion 324 and at least a portion of the connection structure 340. The length of the lower recess 356 as measured in a direction parallel to the longitudinal axis 364 is approximately equal to the length of the end portion 324 as measured in the same direction.

The interface structure 312 further defines a cylindrical surface 368 and includes a stop structure 372 extending away the cylindrical surface. The width of the cylindrical surface 368 is slightly smaller than the diameter of the interior bearing surface 192 (FIG. 3). Accordingly, the cylindrical surface 368 is movable through the opening 190 in the cap 188.

The circular stop structure 372 is positioned at a lower end portion of the interface structure 312. The diameter of the stop structure 372 is greater than the diameter of the opening 190 in the cap 188; therefore, the stop structure is unable to pass through the opening to prevent the worm screw assembly 300 from being separated from the housing 104.

The worm screw assembly 300 is assembled by press fitting the shaft portion 336 into the channel 360 of the interface structure 312. Since the channel 360 is slightly narrower than the shaft portion 336, a friction fit is made between the drive member 308 and the interface structure 312, which prevents separation of the drive structure from the interface structure. The shaft portion 336 is press fit into the channel 360 until the shoulder 344 is positioned against the bottom of the upper recess 352, as shown in FIG. 7.

Next, the end portion 324 is connected to the connection structure 340. The connection is made by threading the end portion 324 onto the connection structure 340 until threads of the end portion 324 become meshingly engaged with the helical groove 348. Since the width of the connection structure 340 is slightly wider than the internal threads 328, a friction fit is formed, which securely connects the worm screw member 304 to the drive member 308. When the end portion 324 is threaded onto the connection structure 340 the longitudinal axis 338 is aligned with the longitudinal axis 316.

Next, the lower recess 356 is filled with an adhesive such as epoxy 376, which bonds to the connection structure 340 and the end portion 324. The epoxy 376 fills the lower recess 356 in a liquid state and, as such, takes the shape of the portion of the lower recess that is unoccupied by the connection structure 340 and the end portion 324. Additionally, the liquid epoxy flows into any spaces between the connection structure 340 and the end portion 324. The epoxy 376 cures and hardens to a solid state and functions to further secure the worm screw member 304 to the drive member 308.

The epoxy 376 also prevents air and liquids from contacting the junction of the worm screw member 304 and the drive member 308. When the worm screw member 304 is connected to the drive member 308 some of the non-stick coating on the worm screw member 304 scrapes off leaving behind an uncoated portion of the worm screw member. The epoxy 376 prevents water and air from contacting the uncoated portion of the worm screw member, thereby preventing the development of corrosion and the like.

The adhesive may also be provided as a glue or sealant that functions similarly or identically to the epoxy 376.

While the disclosure has been illustrated and described in detail in the drawings and foregoing description, the same should be considered as illustrative and not restrictive in character. It is understood that only the preferred embodiments have been presented and that all changes, modifications and further applications that come within the spirit of the disclosure are desired to be protected.

What is claimed is:

1. A corkscrew assembly, comprising:

a housing defining (i) a first opening configured to receive a neck of a bottle, (ii) a second opening, and (iii) an interior space interposed between said first opening and said second opening, said housing including a sidewall extending from said first opening to said second opening, said sidewall defining a first gripper passage and a second gripper passage, and said interior space being interposed between said first gripper passage and said second gripper passage;

a worm screw assembly rotatable in relation to said housing and including (i) a worm screw member having a pointed first end portion and a second opposite end portion and (ii) a drive member fixed in relation to said second opposite end portion, said worm screw assembly being configured such that rotation of said drive member causes rotation of said worm screw;

a first gripper movable in relation to said housing and extending through said first gripper passage;

a second gripper movable in relation to said housing and extending though said second gripper passage;

a first biaser connected to said first gripper; and a second biaser connected to said second gripper, wherein said first gripper, said second gripper, said first biaser, and said second biaser are integrally formed as a single part from an elastomeric material.

2. The corkscrew assembly of claim 1, wherein:

said first gripper is movable between a first position and a second position, said first biaser is configured to urge said first gripper toward said first position, said second gripper is movable between a third position and a fourth position, and said second biaser is configured to urge said second gripper toward said third position.

3. The corkscrew assembly of claim 2, wherein:

said worm screw assembly defines a longitudinal axis that extends through both said first opening and said second opening, said first biaser is configured to urge said first gripper from said second position to said first position in a first direction away from said longitudinal axis, and said second biaser is configured to urge said second gripper from said fourth position to said third position in a second direction away from said longitudinal axis.

4. The corkscrew assembly of claim 1, wherein:

said worm screw assembly further includes an interface structure, said drive member is attached to said interface structure, and said second opposite end of said worm screw is attached to said interface structure.

5. The corkscrew assembly of claim 4, wherein:

said drive member is made of metal, said interface structure is made of plastic, and said worm screw member is made of metal.

6. The corkscrew assembly of claim 4, wherein said interface structure defines:

a first recess in which at least a portion of said drive member is positioned, and a second recess in which at least a portion of said second opposite end of said worm screw member is positioned.

7. The corkscrew assembly of claim 4, wherein:

said housing includes a bore structure defining a cylindrical interior bearing surface, and said worm screw member is positioned in contact with said cylindrical interior bearing surface during rotation of said worm screw assembly.

8. The corkscrew assembly of claim 4, further comprising a cap attached to said housing, wherein:

said housing further includes an abutment structure located in said interior space, said interface structure includes a stop, said worm screw assembly is movable in relation to said housing between a first position and a second position, when said worm screw assembly is positioned in said first position, said stop is positioned in contact with said abutment structure, and when said worm screw assembly is positioned in said second position, said stop is positioned in contact with said cap.

9. The corkscrew assembly of claim 8, wherein:

said cap defines a cylindrical interior bearing surface, and said interface structure is positioned in contact with said cylindrical interior bearing surface during movement of said worm screw assembly from said first position to said second position.

10. A corkscrew assembly, comprising:

a housing defining (i) a first opening configured to receive a neck of a bottle, (ii) a second opening, and (iii) an interior space interposed between said first opening and said second opening, said housing including a sidewall extending from said first opening to said second opening, said sidewall defining a first gripper passage and a second gripper passage, and said interior space being interposed between said first gripper passage and said second gripper passage;

a worm screw assembly rotatable in relation to said housing and including (i) a worm screw member having a pointed first end portion and a second opposite end portion and (ii) a drive member fixed in relation to said second opposite end portion and defining a connection head configured to be received by a rotatable output shaft of a power tool, said worm screw assembly being configured such that rotation of said drive member by said power tool causes rotation of said worm screw assembly;

a first gripper movable in relation to said housing and extending through said first gripper passage; and a second gripper movable in relation to said housing and extending though said second gripper passage a first biaser connected to said first gripper; and a second biaser connected to said second gripper, Wherein said first gripper, said second gripper, said first biaser, and said second biaser are integrally formed as a single part from an elastomeric material and said first biaser and second biaser are located in said interior space.

11. The corkscrew assembly of claim 10, wherein said connection head defines a hexagonal exterior periphery.

12. The corkscrew assembly of claim 10, wherein said drive member defines a shaft portion extending from said connection head and connected to said second opposite end portion of said worm screw member.

* * * * *